US011244773B1

(12) United States Patent
Lee et al.

(10) Patent No.: US 11,244,773 B1
(45) Date of Patent: Feb. 8, 2022

(54) CABLE SHIELDING WITH METAL FOIL

(71) Applicant: GOOGLE LLC, Mountain View, CA (US)

(72) Inventors: Jay Lee, Taipei (TW); H J Fong, Taipei (TW); Bruce Lin, Taipei (TW)

(73) Assignee: Google LLC, Mountain View, CA (US)

( * ) Notice: Subject to any disclaimer, the term of this patent is extended or adjusted under 35 U.S.C. 154(b) by 0 days.

(21) Appl. No.: 17/001,520

(22) Filed: Aug. 24, 2020

(51) Int. Cl.

| | |
|---|---|
| ***H01R 13/648*** | (2006.01) |
| ***H01B 7/18*** | (2006.01) |
| ***H01R 13/02*** | (2006.01) |
| ***H01B 13/00*** | (2006.01) |
| ***H01B 7/20*** | (2006.01) |

(52) U.S. Cl.
CPC ..... *H01B 7/188* (2013.01); *H01B 7/205* (2013.01); *H01B 13/0036* (2013.01); *H01R 13/025* (2013.01)

(58) Field of Classification Search
CPC ..... H01B 7/188; H01B 7/205; H01B 7/0861; H01B 9/003; H01B 9/0515; H01B 11/1813; H01B 11/1016; H01B 12/57; H01B 13/0036; H01B 13/025; H01B 13/6691; H01R 12/722; H01R 13/6594; H01R 13/6581; H01R 13/648; H01R 24/64; H01R 43/18
USPC ..... 174/74 R, 77 R, 78, 84 R, 88 R, 261; 439/607.2, 607.09, 607.13, 607.17, 439/607.24, 607.27, 607.36, 607.37, 439/607.4, 607.56, 607.57, 607.58, 620.1, 439/620.13, 620.14, 579, 660; 385/88
See application file for complete search history.

(56) References Cited

U.S. PATENT DOCUMENTS

| | | | | |
|---|---|---|---|---|
| 7,270,571 | B1 * | 9/2007 | Huang | H01R 4/023 439/607.45 |
| 7,462,071 | B1 * | 12/2008 | Wu | H01R 13/6471 439/607.05 |
| 7,625,236 | B1 * | 12/2009 | Wu | H01R 24/62 439/607.58 |
| 7,651,379 | B1 * | 1/2010 | Wu | H01R 13/6658 439/660 |
| 7,758,374 | B2 * | 7/2010 | Yu | H01R 13/65912 439/493 |
| 9,515,439 | B2 * | 12/2016 | Ng | H01R 43/16 |
| 9,680,260 | B2 * | 6/2017 | Fan | H01R 13/6593 |
| 9,728,898 | B1 * | 8/2017 | Johnson | H01R 13/6581 |
| 10,063,018 | B2 * | 8/2018 | Xing | H01R 13/6581 |
| 10,333,263 | B2 * | 6/2019 | Wu | H01R 24/60 |

(Continued)

*Primary Examiner* — William H. Mayo, III
(74) *Attorney, Agent, or Firm* — Byrne Poh LLP

(57) ABSTRACT

A cable assembly includes a plug receiver, a conductor interface, a metal shell encasing the conductor interface and a portion of a cable of the cable assembly, a metal foil that wraps conformably around an exterior of the metal shell, wherein the metal foil covers substantially all of the exterior of the metal shell and extends beyond the metal shell onto a cable shielding layer. The cable assembly further includes a solder layer disposed about the metal foil, wherein the solder layer bonds and electrically couples the first foil portion to itself, the second foil portion to cable shielding at the location on the plurality of conductors that is proximate to the conductor interface, and the third foil portion to the plug receiver. The cable assembly further includes an electrically insulating layer that encases the metal shell, the metal foil, and the solder layer.

20 Claims, 3 Drawing Sheets

(56) References Cited

U.S. PATENT DOCUMENTS

| | | | | |
|---|---|---|---|---|
| 10,559,400 | B2 * | 2/2020 | Chin | H01B 7/0823 |
| 10,627,578 | B2 * | 4/2020 | Kim | G02B 6/428 |
| 10,777,951 | B2 * | 9/2020 | Wu | H01R 12/70 |
| 2009/0017684 | A1 * | 1/2009 | Lin | H01R 4/2433<br>439/607.41 |
| 2010/0178794 | A1 * | 7/2010 | Hsu | H01R 9/031<br>439/391 |
| 2011/0028038 | A1 * | 2/2011 | Luo | H01R 13/648<br>439/607.58 |
| 2011/0195609 | A1 * | 8/2011 | Su | H01R 4/2433<br>439/660 |
| 2011/0249948 | A1 * | 10/2011 | Wu | G02B 6/3817<br>385/89 |
| 2012/0063727 | A1 * | 3/2012 | Wu | G02B 6/3817<br>385/88 |
| 2013/0164990 | A1 * | 6/2013 | Tsai | H01R 24/62<br>439/660 |
| 2021/0076462 | A1 * | 3/2021 | Lin | H05B 6/6497 |

* cited by examiner

CABLE SHIELDING WITH METAL FOIL

TECHNICAL FIELD

This relates to a cable assembly with an inner shell and metal foil, the cable assembly having improved electromagnetic shielding and structural integrity.

BACKGROUND

A cable assembly includes cable components and connector components. Cable components may include one or more electrical conductors (e.g., wires), and connector components may include a receptacle and/or a plug having electrical contacts configured for physical coupling with corresponding electrical contacts in devices configured to connect with the receptacle and/or the plug. In some instances, the interface between the cable and connector components may be a source of structural weakness and/or noise (e.g., electromagnetic interference (EMI) and/or radio frequency interference (RFI)). Such noise may cause degradation in sensitivity (desense) of wireless communication components in proximity to the connector components.

SUMMARY

This disclosure describes a cable assembly with improved structural integrity and shielding. A connector of the cable assembly provides improved structural support at the interface between cable and connector components. The connector also provides improved shielding, thereby reducing the amount of desense-causing noise that may negatively affect wireless communication components in proximity to the connector.

In one aspect, a cable assembly includes a connector head electrically coupled to a plurality of conductors disposed in a cable, the connector head having a plug receiver and a conductor interface. The cable assembly further includes a metal shell including a first shell portion encasing the conductor interface of the connector head, and a second shell portion encasing a portion of the cable. The cable assembly further includes a metal foil that wraps conformably around an exterior of the metal shell, wherein the metal foil covers substantially all of the exterior of the metal shell, including (i) a first foil portion that covers the first shell portion, (ii) a second foil portion that covers and extends beyond the second shell portion and onto shielding of the cable (also referred to as a grounding layer of the cable) surrounding the plurality of conductors at a location on the plurality of conductors that is proximate to the conductor interface, and (iii) a third foil portion that extends beyond the first shell portion and onto a portion of the plug receiver. The cable assembly further includes a solder layer disposed about the metal foil, wherein the solder layer bonds and electrically couples: (i) the first foil portion to itself, (ii) the second foil portion to the shielding of the cable at the location on the plurality of conductors that is proximate to the conductor interface, and (iii) the third foil portion to the plug receiver. The cable assembly further includes an electrically insulating layer that encases the metal shell, the metal foil, and the solder layer.

BRIEF DESCRIPTION OF THE DRAWINGS

The following figures depict various views of implementations described in the Detailed Description below. Features shared between figures are similarly numbered.

DETAILED DESCRIPTION

Figure 1:
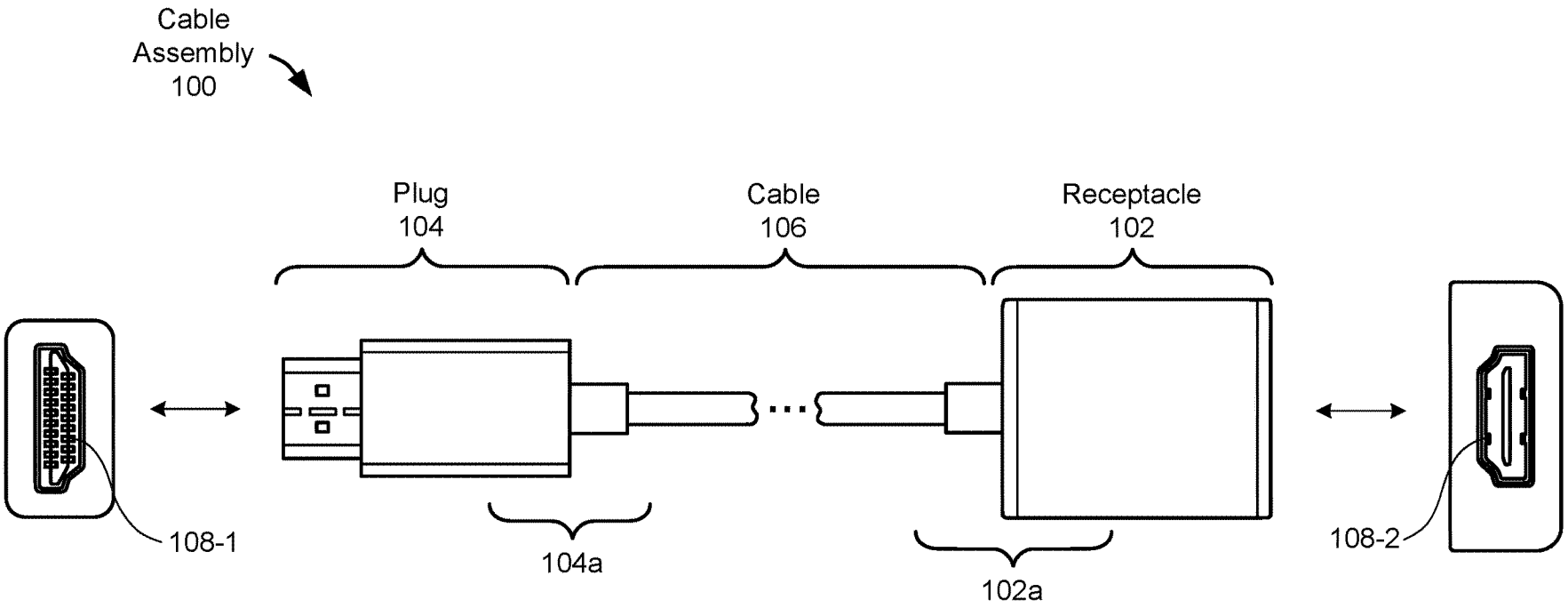
FIG. 1 depicts an example cable assembly in accordance with some implementations.

FIG. 1 depicts an example cable assembly 100 in accordance with some implementations. The cable assembly 100 includes a receptacle 102 (also referred to as a female connector or connector head), a plug 104 (also referred to as a male connector or connector head), and a cable 106. The cable 106 includes one or more electrical conductors (e.g., wires, not shown in FIG. 1), and the receptacle 102 and plug 104 each include one or more electrical contacts 108 configured for physical coupling with corresponding electrical contacts in a device (not shown in FIG. 1) configured to connect with the receptacle 102 or plug 104. The receptacle 102 joins the cable 106 at a first interface region 102*a*, and the plug 104 joins the cable 106 at a second interface region 104*a*. The interface regions 102*a* and 104*a* include components (described in more detail with reference to FIG. 2 below) that optimize electromagnetic shielding of the cable assembly 100.

In some implementations, the receptacle 102 is a High-Definition Multimedia Interface (HDMI) receptacle, the plug 104 is an HDMI plug, and the cable 106 includes a plurality of conductors in accordance with the HDMI standard. Such a cable assembly 100 may be referred to as an HDMI cable extender, the use of which increases the distance between a device that may be sensitive to interference and is connected to the receptacle 102 (e.g., a wireless streaming dongle, not shown) and a device that may cause interference and is connected to the plug 104 (e.g., a television, not shown). The increased distance, when combined with the shielding features described below, decreases the sensitivity of the device that may be sensitive to interference, thereby increasing performance of such a device (e.g., resulting in fewer dropped packets).

Figure 2:
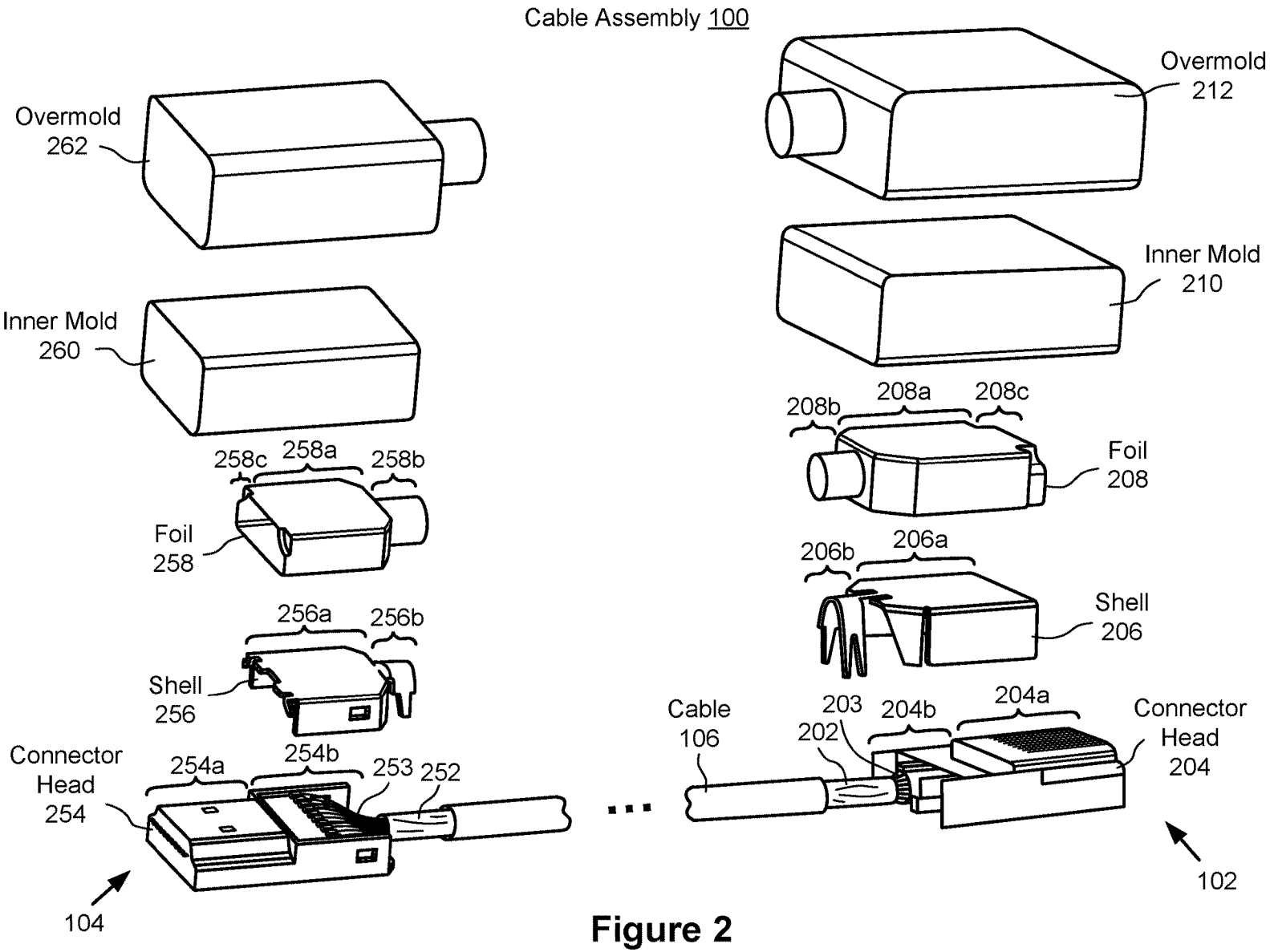
FIG. 2 depicts an exploded view of the cable assembly of FIG. 1 in accordance with some implementations.

FIG. 2 depicts an exploded view of the cable assembly 100 including the plug 104, the receptacle 102, and the cable 106 as described with reference to FIG. 1 above. The receptacle 102 includes a connector head 204 that is electrically coupled to a plurality of conductors 203 disposed in the cable 106, the connector head 204 having a plug receiver 204*a* (e.g., configured to mate with an HDMI plug of an external device, not shown) and a conductor interface 204*b*. The conductor interface 204*b* electromechanically couples the conductors 203 to corresponding positions (e.g., metal contacts) in the plug receiver 204*a*. The conductor interface 204*b* optionally includes a printed circuit board (PCB) assembly (not shown), on which the conductors 203 are electromechanically coupled (e.g., soldered to metal contacts on the PCB). Alternatively, the conductors 203 may be electromechanically coupled to corresponding positions (e.g., metal contacts) in the plug receiver 204*a* without the presence of a PCB assembly. The conductor interface 204*b* may include electrical termination and/or structural components for terminating and stabilizing the conductors 203. For example, one or more ground bars (not shown) may be electrically coupled to shielding 202 of the cable 106 and to the conductor interface 204*b*, thereby providing grounding for the shielding 202 of the cable 106. The shielding 202 comprises any electrically conductive material (e.g., copper grounding braid or sheath) that runs the length of the cable 106. In some implementations, an inner mold (e.g., glue, not shown) is disposed throughout the conductor interface 204*b*, thereby providing protection to components of the conductor interface 204*b* during the manufacturing process. In some implementations, the connector head 204 comprises plastic (e.g., liquid crystal polymer) or any other material with insulating properties.

A metal shell 206 (also referred to as a shielding frame) is disposed about, and in contact with, a portion of the connector head 204. Specifically, the metal shell 206 includes a first shell portion 206*a* encasing the conductor interface 204*b* of the connector head 204, and a second shell portion 206*b* encasing a portion of the cable 106 that is proximate to the conductor interface 204*b* (e.g., a portion of the cable 106 including the exposed shielding 202). The metal shell 206 is a structural support for the interface region 102*a* (FIG. 1) between the connector head 204 and the cable 106, as it grips or is otherwise physically coupled to both (i) conductor interface 204*b* of the connector head 204, and (ii) the cable 106. The second shell portion 206*b* may be crimped to the shielding 202 of the cable 106 for structural support and for grounding of the metal shell 206. The metal shell 206 also provides shielding to the conductors 203 at the conductor interface 204*b*. In some implementations, the metal shell 206 comprises steel (e.g., carbon steel such as SPCC steel) or any other material having a tensile strength that is high enough to withstand the force of the cable assembly 100 being unplugged from a device while a user grips the cable 106.

The receptacle 102 includes a metal foil 208 (also referred to as a shielding foil) disposed about, and in contact with, the metal shell 206. Specifically, the metal foil 208 wraps around the exterior surfaces of the metal shell 206 and the connector head 204. As a result of the wrapping, the metal foil 208 conforms to the surfaces of the underlying metal shell 208 and connector head 204. The metal foil 208 provides another layer of shielding to the conductors 203 at the conductor interface 204*b*. As such, in order to seal any gaps between the connector head 204 and the metal shell 206, the metal foil 208 covers substantially all of the exterior of the metal shell 206. Stated another way, the metal foil 208 extends to the full extent of the metal shell 206 and extends beyond the metal shell 206 in the direction of the plug receiver 204*a* and in the direction of the cable shielding 202. The combination of metal shell 206 and metal foil 208 form a double shield around the conductor interface 204*b*.

The metal foil 208 includes three portions: a first foil portion 208*a* covers the first shell portion 206*a*, a second foil portion 208*b* covers and extends beyond the second shell portion 206*b* and onto the shielding 202 surrounding the conductors 203 at a location proximate to the conductor interface 204*b*, and a third foil portion 208*c* extends beyond the first shell portion 206*a* and onto a portion of the plug receiver 204*a*. Since all three foil portions 208*a*, 208*b*, and 208*c* are portions of the same piece of foil, the metal foil 208 (*i*) completely covers the first and second shell portions 206*a* and 206*b*, (ii) extends past the first shell portion 206*a* to close any gaps between the first shell portion 206*a* and the plug receiver 204*a*, and (iii) extends past the second shell portion 206*b* to close any gaps between the second shell portion 206*b* and the cable shielding 202. In some implementations, the metal foil 208 comprises copper, aluminum, gold, or any other metallic sheet or foil material that is electrically conductive.

The receptacle 102 includes an overmold 212 disposed about the receptacle components described above. Specifically, the overmold 212 is an electrically insulating layer that encases the plug receiver 204*a* and the conductor interface 204*b* of the connector head 204, the metal shell 206, and the metal foil 208. In some implementations, the overmold 212 comprises a thermoplastic elastomer (TPE), or any other material with thermoplastic and/or elastomeric properties. In some implementations, an inner mold 210 is disposed about the metal foil 208 before the overmold 212 is applied, thereby protecting the double seal provided by the metal shell 206 and the metal foil 208 during application of the overmold 212. The inner mold 210 may also comprise a TPE (e.g., having a type requiring a lower temperature during application as compared to the TPE type used for the overmold 212), or any other material with thermoplastic and/or elastomeric properties.

Figure 3B:
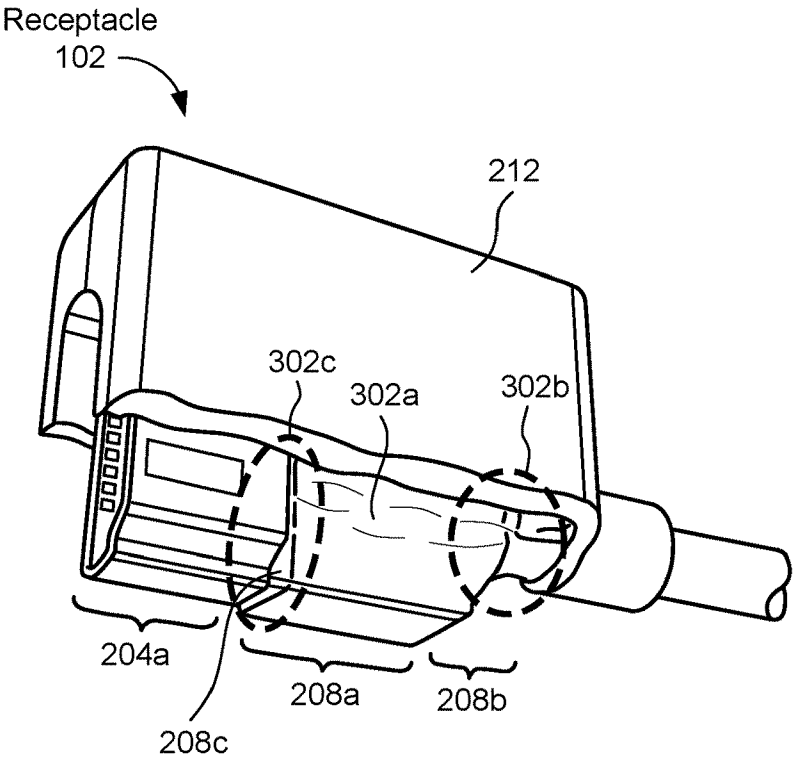
FIGS. 3A and 3B depict cutaway views of a receptacle of the cable assembly of FIG. 1 in accordance with some implementations.
Figure 3A:
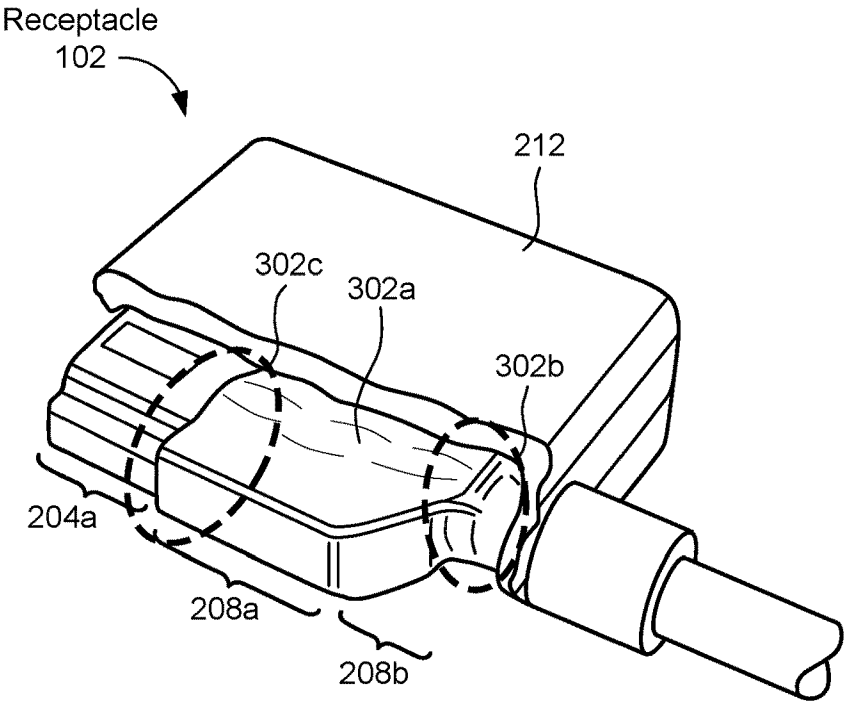

FIGS. 3A and 3B depict cutaway views of the receptacle 102 of the cable assembly 100 in accordance with some implementations. While the metal foil 208 and the metal shell 206 (not shown since it is encased in the metal foil 208) form a double shield around the conductor interface 204*b*, there may still be gaps in the foil material itself (e.g., as a result of uneven foil wrapping during manufacturing of the cable assembly 100), thereby affecting the shielding quality of the metal foil 208. To address these potential gaps in the foil material, a solder layer seals the double shield comprising the metal shell 206 and the metal foil 208. The solder layer includes three portions, solder portions 302*a*, 302*b*, and 302*c*, which are applied to the first, second, and third foil portions 208*a*, 208*b*, and 208*c*, respectively. More specifically, (i) solder portion 302*a* bonds and electrically couples the first foil portion 208*a* to itself (thereby sealing overlapping ends resulting from the wrap process), (ii) solder portion 302*b* bonds and electrically couples the second foil portion 208*b* to the cable shielding 202 at the location on the plurality of conductors 203 that is proximate to the conductor interface (thereby closing any gaps where the foil meets the shielding 202 and providing enhanced grounding to the metal foil 208), and (iii) solder portion 302*c* bonds and electrically couples the third foil portion 208*c* to the plug receiver 204*a* (thereby closing any gaps where the foil meets the plug receiver 204*a*). In some implementations, the solder layer bonds and electrically couples the metal foil 208 to the metal shell 206. In addition to the shielding and grounding features provided by the solder layer, the solder layer provides rigidity and protects the metal foil 208 during manufacturing of the cable assembly 100.

While the double shielding and sealing features are described above with reference to the receptacle 102, the aforementioned features apply equally to the plug 104. Specifically, referring to FIG. 2, the plug includes a connector head 254, which corresponds to the connector head 204, although instead of a plug receiver 204*a*, the connector head 254 includes a plug 254*a*. The connector head 254 also includes a conductor interface 254*b*, which corresponds to the conductor interface 204*b* described above. The plug 104 also includes a metal shell 256 having a first shell portion 256*a* and a second shell portion 256*b*, which correspond to the first shell portion 206*a* and the second shell portion 206*b*, respectively, of the metal shell 206 described above. The plug also includes a metal foil 258 having a first foil portion 258*a*, a second foil portion 258*b*, and a third foil portion 258*c*, which correspond to the first, second, and third foil portions 208*a*, 208*b*, and 208*c*, respectively, of the metal foil 208 described above. The plug 104 also includes an overmold 262 and, in some implementations, an inner mold 260, which correspond to the overmold 212 and the inner mold 210 of the receptacle 102 described above.

Each of the aforementioned parts of the plug 104 has the same features as its corresponding part of the receptacle 102, except for minor differences in shape (e.g., due to the plug 104 having a different form factor compared to the receptacle 102). Specifically, the metal shell 256 and the metal foil 258 form a double shield around the conductors 253 in the conductor interface 254*b* (as described above with reference to the double shield in the receptacle 102), and the double shield is sealed with a solder layer to the plug 254*a* and the cable shielding 252 (as described above with reference to the solder layer in the receptacle 102).

CONCLUSION

The metal shell 206/256, metal foil 208/258, and solder layer 302, when disposed in a cable assembly 100 as described above with reference to FIGS. 2, 3A, and 3B, form a double shielding structure that keeps desense-causing noise sealed inside the connector (plug/receptacle) of a cable assembly. This improved noise rejection allows for improvements in applications involving wireless transmission (e.g., streaming video data via a wireless dongle attached to a television). In addition, the metal foil 208/258 and the solder layer 302, when disposed in a cable assembly 100 as described herein, improve structural integrity of the interface regions 102*a* and 104*a* (FIG. 1) of the cable assembly 100 by reinforcing the physical coupling of the metal shell 206/256 with the connector head 204/254 and the cable shielding 203/253. These improvements may be implemented at a receptacle only (e.g., 102), at a plug only (e.g., 104), or at both a receptacle and a plug as described herein.

The foregoing description has been described with reference to specific implementations. However, the illustrative discussions above are not intended to be exhaustive or to limit the claims to the precise forms disclosed. Many variations are possible in view of the above teachings. The implementations were chosen and described to best explain principles of operation and practical applications, to thereby enable others skilled in the art.

The various drawings illustrate a number of elements in a particular order. However, elements that are not order dependent may be reordered and other elements may be combined or separated. While some reordering or other groupings are specifically mentioned, others will be obvious to those of ordinary skill in the art, so the ordering and groupings presented herein are not an exhaustive list of alternatives.

As used herein: the singular forms "a", "an," and "the" include the plural forms as well, unless the context clearly indicates otherwise; the term "and/or" encompasses all possible combinations of one or more of the associated listed items; the terms "first," "second," etc. are only used to distinguish one element from another and do not limit the elements themselves; the term "if" may be construed to mean "when," "upon," "in response to," or "in accordance with," depending on the context; and the terms "include," "including," "comprise," and "comprising" specify particular features or operations but do not preclude additional features or operations.

What is claimed is:

1. A cable assembly, comprising:

a connector head electrically coupled to a plurality of conductors disposed in a cable, the connector head having a plug receiver and a conductor interface;

a metal shell including:

a first shell portion encasing the conductor interface of the connector head, and a second shell portion encasing a portion of the cable;

a metal foil that wraps conformably around an exterior of the metal shell, wherein the metal foil covers substantially all of the exterior of the metal shell, including:

a first foil portion that covers the first shell portion, a second foil portion that covers and extends beyond the second shell portion and onto a grounding layer surrounding the plurality of conductors at a location on the plurality of conductors that is proximate to the conductor interface, and a third foil portion that extends beyond the first shell portion and onto a portion of the plug receiver;

a solder layer disposed about the metal foil, wherein the solder layer bonds and electrically couples:

the first foil portion to itself, the second foil portion to the grounding layer at the location on the plurality of conductors that is proximate to the conductor interface, and the third foil portion to the plug receiver; and an electrically insulating layer that encases the metal shell, the metal foil, and the solder layer.

2. The cable assembly of claim 1, wherein:

the metal shell and the metal foil form a double shield around the conductor interface; and the solder layer seals the double shield.

3. The cable assembly of claim 1, wherein the solder layer bonds and electrically couples the metal foil to the metal shell.

4. The cable assembly of claim 1, wherein the solder layer provides rigidity and protects the metal foil during manufacturing of the cable assembly.

5. The cable assembly of claim 1, wherein the electrically insulating layer includes:

an inner layer that encases entirely the metal shell, metal foil, and solder layer; and an outer layer that encases entirely the inner layer and forms an exterior of the connector head of the cable assembly.

6. The cable assembly of claim 1, wherein the second shell portion is crimped to the grounding layer.

7. The cable assembly of claim 1, wherein the metal shell comprises steel.

8. The cable assembly of claim 1, wherein the metal foil comprises copper, aluminum, or gold.

9. The cable assembly of claim 1, wherein the connector head is a High-Definition Multimedia Interface (HDMI) receptacle.

10. The cable assembly of claim 9, further comprising an HDMI plug, wherein the HDMI plug includes:

a double shield comprising a second metal shell and second metal foil;

a second solder layer disposed about the second metal foil; and a second electrically insulating layer that encases the second metal shell, the second metal foil, and the second solder layer.

11. A cable assembly, comprising:

a connector head electrically coupled to a plurality of conductors disposed in a cable;

a metal shell encasing a portion of the connector head and a portion of the cable;

a metal foil that wraps conformably around an exterior of the metal shell, wherein the metal foil covers substantially all of the exterior of the metal shell and extends beyond the metal shell (i) onto a grounding layer surrounding the plurality of conductors, and (ii) onto a portion of the connector head; and a solder layer disposed about the metal foil, wherein the solder layer bonds and electrically couples the metal foil (i) to the grounding layer, and (ii) to the connector head.

12. The cable assembly of claim 11, wherein: the metal shell and the metal foil form a double shield around a conductor interface of the connector head; and the solder layer seals the double shield.

13. The cable assembly of claim 11, wherein the solder layer bonds and electrically couples the metal foil to the metal shell.

14. The cable assembly of claim 11, wherein the solder layer provides rigidity and protects the metal foil during manufacturing of the cable assembly.

15. The cable assembly of claim 11, further comprising: an electrically insulating layer that encases the metal shell, the metal foil, and the solder layer, wherein the electrically insulating layer includes:

an inner layer that encases entirely the metal shell, metal foil, and solder layer;

and an outer layer that encases entirely the inner layer and forms an exterior of the connector head of the cable assembly.

16. The cable assembly of claim 11, wherein a portion of the metal shell is crimped to the grounding layer.

17. The cable assembly of claim 11, wherein the metal shell comprises steel.

18. The cable assembly of claim 11, wherein the metal foil comprises copper, aluminum, or gold.

19. The cable assembly of claim 11, wherein the connector head is a High-Definition Multimedia Interface (HDMI) receptacle.

20. The cable assembly of claim 19, further comprising an HDMI plug, wherein the HDMI plug includes:

a double shield comprising a second metal shell and second metal foil; and a second solder layer disposed about the second metal foil.

* * * * *